United States Patent [19]

Ferris et al.

[11] 4,199,311

[45] Apr. 22, 1980

[54] SPRING BIASED EXTRUSION DEVICE FOR SURFACE PATTERNING

[75] Inventors: Michael J. Ferris, Chicago; Howard J. Morrison, Deerfield, both of Ill.

[73] Assignee: Marvin Glass & Associates, Chicago, Ill.

[21] Appl. No.: 945,510

[22] Filed: Sep. 25, 1978

[51] Int. Cl.[2] ..... B28B 19/00

[52] U.S. Cl. ..... 425/173; 222/336; 425/87; 425/191; 425/376 R

[58] Field of Search ..... 425/376 R, 87, 173, 425/190, 191, 192, 458, 447, 449; 222/558

[56] References Cited

U.S. PATENT DOCUMENTS

| | | | |
|---|---|---|---|
| 354,106 | 12/1886 | Dorwart | 222/558 |
| 660,952 | 10/1900 | Hall | 425/376 R |
| 796,246 | 8/1905 | Printz | 425/87 |
| 977,282 | 11/1910 | Devilbiss | 425/87 |
| 1,126,253 | 1/1915 | Morris | 425/87 |
| 1,126,996 | 2/1915 | Hassler | 425/87 |
| 1,397,510 | 11/1921 | Grassi | 425/376 R |
| 1,526,112 | 2/1925 | Blackaller et al. | 425/376 R |
| 1,891,280 | 12/1932 | Hazlett et al. | 222/558 |
| 3,524,222 | 8/1970 | Gregory et al. | 425/173 |
| 3,590,749 | 7/1971 | Burns et al. | 425/173 |
| 3,664,788 | 5/1972 | Greenberg | 425/376 R |
| 3,685,936 | 8/1972 | Meth et al. | 425/376 R |
| 3,874,571 | 5/1975 | Higgs | 222/558 |

FOREIGN PATENT DOCUMENTS

| | | | |
|---|---|---|---|
| 475118 | 1/1915 | France | 425/87 |
| 333815 | 8/1930 | United Kingdom | 425/87 |
| 572665 | 10/1945 | United Kingdom | 425/87 |

*Primary Examiner*—Paul Lieberman
*Assistant Examiner*—Arthur H. Koeckert
*Attorney, Agent, or Firm*—Mason, Kolehmainen, Rathburn & Wyss

[57] ABSTRACT

An extrusion implement includes a pair of generally cylindrical housing portions connected to one another by sets of complementary threads to permit a telescoping of one portion into the other. An open end of the smaller cylindrical portion is partially closed or restricted by one of a plurality of end caps providing various shaped apertures. A viscous material, such as modeling clay, is inserted within the cylindrical portions and a biasing device is provided to constantly urge the viscous material outwardly through the aperture. Relative rotation of the housing portions causes a telescoping effect to regulate the amount of pressure applied by the biasing device. An end cap is pivotally mounted to close the opening when the implement is not in use.

9 Claims, 5 Drawing Figures

SPRING BIASED EXTRUSION DEVICE FOR SURFACE PATTERNING

BACKGROUND OF THE INVENTION

1. Field of the Invention

This invention relates to extruders that are used to project viscous material out of the device and, in particular, to a pencil which may be used to create various patterns in that semi-solid material upon a desired surface.

2. Description of the Prior Art

In the past, various types of pencil items have been used to produce patterns on desired surfaces. Few, however, have used a semi-solid, viscous material and fewer have also attempted to form that material into a desired ornate and/or useful pattern. Some devices such as caulking guns and the like have been used to project semi-solid materials but the pattern has usually been not an object of the device. The prior art has usually employed a pivoted pawl and elongated notched rod which enters the rear or top of the invention to project semi-solid materials out of the devices, such as shown in U.S. Pat. No. 3,157,933. The present invention includes an internal volume filled with the viscous material which is pressurized by a spring during telescoping of the device resulting in a flow of materials out of an opening in the device.

SUMMARY OF THE INVENTION

An object of the present invention is to provide a new and improved extruder pencil which projects viscous materials in desired patterns and which may be used by individuals of all ages. In accordance with this and other objects of the present invention, one embodiment is shown and described herein and includes an extruder pencil in which is placed a viscous material which, when the pencil is properly operated, is pushed from the bottom of the pencil and onto a surface which is selected by the user. The pencil is comprised of an upper portion which interacts with the lower portion and that interaction via the use of threaded sections causes a corresponding movement in a biasing means positioned inside the device. This biasing means forces viscous materials which have been placed inside of the extruder pencil by the user, out of the opening of the bottom of the lower portion to which is attached a funneling portion and ultimately the material is forced through that funneling portion with its corresponding bottom opening and shapers attached to the bottom. The result is a pattern of viscous material which is both useful and entertaining.

Other objects, features and advantages of the invention will be apparent in the following detailed description taken in connection with the accompanying drawings.

DESCRIPTION OF THE PREFERRED EMBODIMENT

Figure 1:
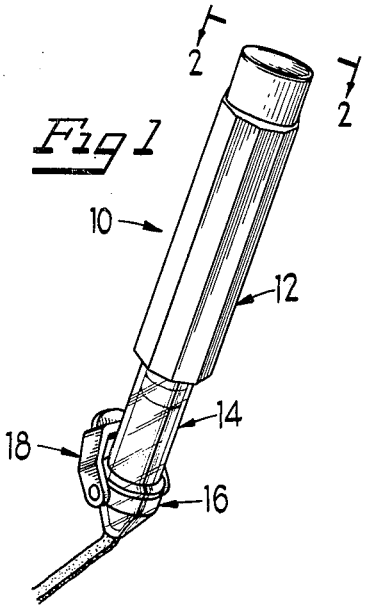
FIG. 1 is a perspective view of an extruder pencil embodying the concepts of the present invention.

Referring to FIG. 1, the present invention generally designated 10 provides an extrusion implement, such as a pencil, or the like, having an upper housing 12, a lower housing 14, a funneling portion 16 and a generally U-shaped holder 32.

Figure 2:
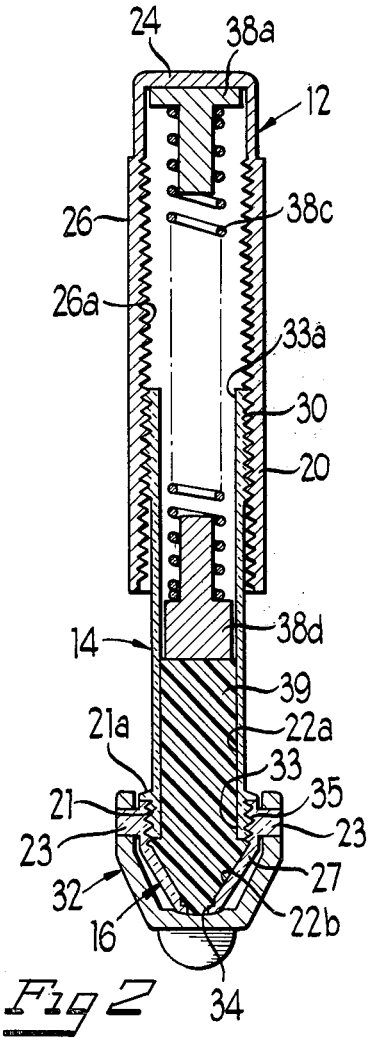
FIG. 2 is a vertical section, on an enlarged scale, of the apparatus shown in FIG. 1 taken generally along line 2—2 of FIG. 1.
Figure 3:
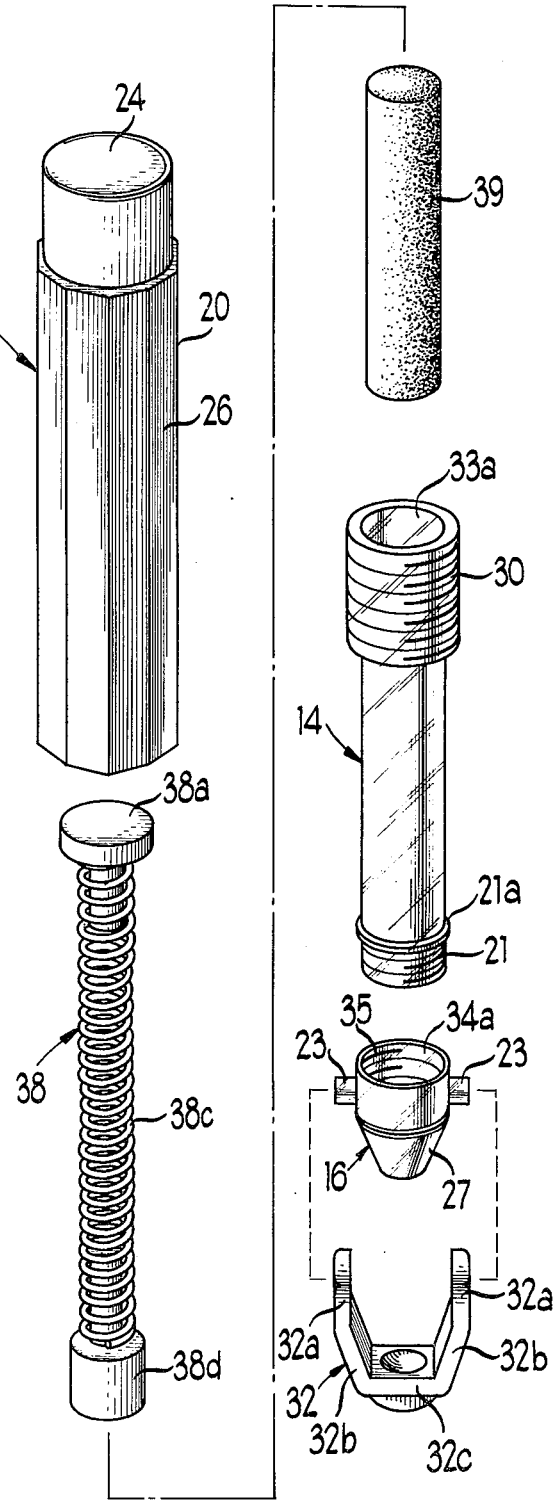
FIG. 3 is an exploded perspective view, on an enlarged scale, of the invention as contemplated by FIG. 1.

Referring to FIGS. 2 and 3, the upper housing 12 includes an elongated cylindrical wall 20 closed at the top end by an end cap 24. The wall 20 includes interior thread **26*a* and an exterior grippable, ten-sided surface 26. The lower housing 14 includes a clear plastic cylindrical portion having an open bottom 33 and open top 33*a* which are in communication with a generally cylindrical bore 22*a*, defining a hollow cavity. The cylindrical outer wall of the lower housing has a threaded section 30 (FIG. 3) at the upper part of the lower housing intended for engagement with the threaded sections 26*a* on the interior of the upper housing 26. A lower threaded section 21, at the bottom, open end of the housing, terminates in a flange 21*a***.

The funneling portion 16 has an open bottom 34 and top **34*a* which are in communication with a hollowed portion 22*b*. This hollowed portion 22*b* has an upper cylindrical section and a lower tapered section. Complementary threads are provided on the upper inner walls of the funneling portion, generally designated 35, to mount the funneling portion 16 on the end of the lower portion 21. This upper section of the funneling housing is in communication with a tapering portion 27 which focuses to the open bottom 34 of the funneling housing. Two radially disposed protuberances 23 are attached to the outside walls of the funneling housing 16 for pivotally mounting a generally U-shaped holder 32 (FIG. 3). This type of mounting allows for the U-shaped holder 32 to be swung away from the bottom of the funneling housing during operation of the pencil thereby allowing passage of viscous material from the inside of the pencil extruder to the outside. When the pencil extruder is no longer in use, the U-shaped holder 32 may be swung into place thereby blocking further accidental or unintentional flow of viscous material from the inside of the pencil extruder 10. The U-shaped holder 32 has an upper portion 32*a* generally parallel with the lengths of both the upper and lower housing of the pencil extruder. The U-shaped holder has a slanting portion 32*b* which connects the upper portion 32*a* of the U-shaped holder to the bottom plate 32*c* of the U-shaped holder 32. The contact between this bottom flattened plate 32*c* and the open hole at the bottom of the funneling housing 34** stops the flow of material out of the pencil extruder when in the position as shown in FIG. 2.

FIG. 3 discloses the preferred embodiment of a biasing means generally designated 38. This biasing means includes an upper pad **38*a* for contacting the top wall 24 of the hollowed cavity of the upper housing 12. A shaft or pin on the pad centers a coil spring 38*c* with the upper housing 12. A piston or ram, designated 38*d*, is similarly mounted on the bottom of the spring 38*c* and extends into the lower housing 14. A viscous material 39 is inserted in the lower housing portion 14** and extruded out of the device by the spring pressure. The lower housing may be moved progressively into the upper housing by relative rotation of the threaded sections to maintain spring pressure.

Figure 4:
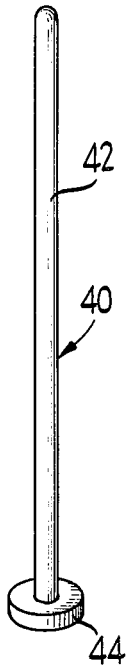
FIG. 4 is a perspective view of a plunger for use in inserting a predetermined amount of viscous material.

The invention also includes a filler or ram rod generally designated 40 (FIG. 4). The ram rod comprises a generally long, thin extension 42 which is permanently affixed to a circular base plate 44. The base plate 44 is generally cylindrical in shape, and has a diameter which is less than the bore of the lower housing 14 of the extruder pencil. The rod is used for loading the viscous material 39 into the lower housing prior to assembly.

Figure 5:
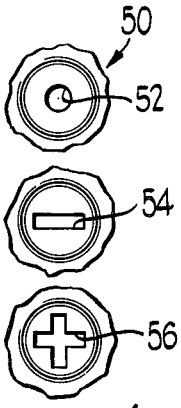
FIG. 5 is a top planar, partial sectional view of the funneling portion of the invention showing the various configurations which the shaper portion of the funnel may take.

FIG. 5 shows the lower portion of a plurality of funneling housings, generally designated 50. The drawings illustrate various configurations at the bottom opening of the funneling housing such as circular 52, rectangular 54 or cross-shaped 56. These configurations are merely illustrative and shall not be construed so as to limit the scope of the invention since some modification will be apparent to those skilled in the art. When the extruder is in operation, the viscous material 39 is forced through these openings and results in the desired configurations and resultant pattern of viscous material.

In its intended use, the apparatus will be used to form various patterns of viscous materials. The upper housing 12 is turned to maintain pressure on the material 39 by reducing the internal volume of the extruder pencil. The biasing means 38 then transforms that volume change into a proportional increase in pressure upon the viscous material thereby causing a forced flow of the viscous material 39 out of the extruder pencil to permit the construction of artwork or other designs.

The foregoing detailed description has been given for clearness of understanding only and no unnecessary limitations should be understood therefrom as some modifications will be obvious to those skilled in the art.

We claim:

1. A toy extrusion device for modeling clay, or the like, comprising:

an upper housing having an open end, a closed end, and a longitudinally extending bore in communication with said open end and defining inner walls in said upper housing;

a plurality of internal threads extending along the inner walls and friction generating means extending along the exterior of the walls to facilitate rotating the same;

a generally hollow lower housing having an open bottom and top, a longitudinally extending cylindrical bore in communication with both said open bottom and top, the outer surface of said lower housing being provided with an external threaded section at the top and bottom ends, the threaded section at the top of said lower housing being engageable with the internal threaded section of said upper housing to permit telescoping of the respective upper and lower housing portions to decrease the length of the bore upon relative rotation;

a plurality of removable funneling housings mountable, one at a time, to said lower housing, an upper portion of said funneling housings each having a generally cylindrical bore larger than the outer diameter of said lower housing, a portion of the wall defining said cylindrical bore having a threaded section for selective engagement with the threaded section on the lower end of said lower housing, said funneling housing bores tapering to a predetermined shaped opening at the opposite end of said funneling housing;

means for providing access into said cavity to insert a predetermined amount of viscous material; and biasing means within the bores of the upper and lower housings for applying a biasing force to said viscous material to expel the material through said funneling portion, said biasing means including an upper rigid portion for centering a spring and for engagement with the closed end of said upper housing, a spring, and a lower movable piston for engaging said viscous material under the influence of said spring and for increasing the pressure applied to the viscous material as said upper and lower portions are telescoped by relative rotation to controllably force said material through said funneling housing so that a continuous line of extruded material can be formed.

2. The extrusion device of claim 1 wherein said lower housing is made of transparent material to permit viewing of the viscous material within the cavity.

3. The extrusion device of claim 1 including a pair of radially disposed protuberances on said funneling portion and an end cap pivotally mounted to said protuberances for engaging said bottom opening to selectively prevent extrusion of said viscous material under the pressure of the biasing means.

4. The extrusion device of claim 1 including a plurality of cylindrically shaped slugs of viscous material.

5. The extrusion device of claim 1 wherein said spring is a coil spring.

6. The extrusion device of claim 5 wherein said friction generating means comprises a plurality of facets on the exterior of said upper housing.

7. The extrusion device of claim 6 including a separate ramrod for injecting a predetermined amount of viscous material into the lower housing portion.

8. The extrusion device of claim 7 including a pair of radially disposed protuberances on said funneling portion and an end cap pivotally mounted to said protuberances for engaging said bottom opening to selectively prevent extrusion of said viscous material under the pressure of the biasing means.

9. The extrusion device of claim 8 wherein said lower housing portion includes stop means at the upper end of said lower threaded section for providing a stop when mounting said funneling housing portion on the end thereof.

* * * * *